US005957052A

United States Patent [19]

Endisch et al.

[11] Patent Number: 5,957,052

[45] Date of Patent: Sep. 28, 1999

[54] PRINTING MACHINE ROLLER, ESPECIALLY AN INK ROLLER, WITH AN INK-FRIENDLY COATING OF THE CYLINDER SURFACE OF THE ROLLER CORE

[75] Inventors: Martin Endisch, Wertingen; Gerhard Johner, Gelnhausen, both of Germany

[73] Assignee: MAN Roland Druckmaschinen AG, Offenbach am Main, Germany

[21] Appl. No.: 08/995,329

[22] Filed: Dec. 22, 1997

[30] Foreign Application Priority Data

Dec. 21, 1996 [DE] Germany ..... 196 53 911

[51] Int. Cl.[6] ..... B41F 13/10

[52] U.S. Cl. ..... 101/375; 101/217; 428/909

[58] Field of Search ..... 101/375, 217, 101/216, 214, 213, 376, 379; 428/909, 379; 29/527.2, 527.5, 527.6

[56] References Cited

U.S. PATENT DOCUMENTS

| | | | |
|---|---|---|---|
| 4,662,045 | 5/1987 | Grodum | 29/148.4 |
| 4,967,663 | 11/1990 | Metcalf | 101/348 |
| 5,468,568 | 11/1995 | Kuhn et al. | 428/245 |
| 5,603,264 | 2/1997 | DeMoore et al. | 101/483 |

FOREIGN PATENT DOCUMENTS

| | | |
|---|---|---|
| 28 53 594 | 3/1982 | Germany . |
| 35 25 045 | 1/1987 | Germany . |
| 35 27 912 | 2/1987 | Germany . |
| 43 15 813 | 11/1994 | Germany . |

*Primary Examiner*—Edgar Burr
*Assistant Examiner*—Dave A. Ghatt
*Attorney, Agent, or Firm*—Cohen, Pontani, Lieberman & Pavane

[57] ABSTRACT

A printing machine roller, especially an ink roller, and preferably an ink distributor roller, with a coating of the entire outer cylindrical surface. The coating consists of a support matrix of a good heat-conducting and low-wear metal, e.g., nickel or aluminum-silicon alloy and graphite or plastic particles, e.g., of polyester, inlaid into the metal matrix. The coating is produced by thermal spraying, preferably plasma spraying or flame spraying. The residual porosity of the coating can be varied within wide limits based on process requirements. This residual porosity also permits the ink-friendliness to be varied within wide limits via sealing with an ink-friendly plastic. The roughness of such layers can be adjusted virtually as desired to the individual requirements of the offset process.

20 Claims, 1 Drawing Sheet

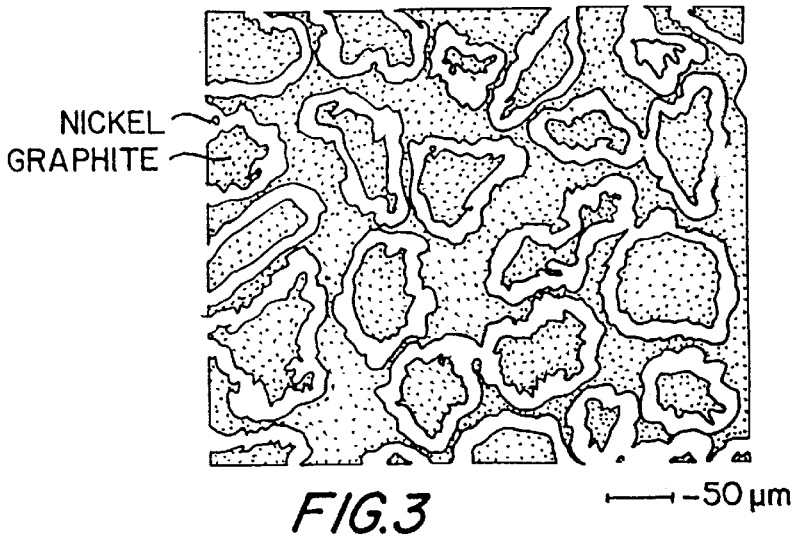
FIG.3
FIG.2
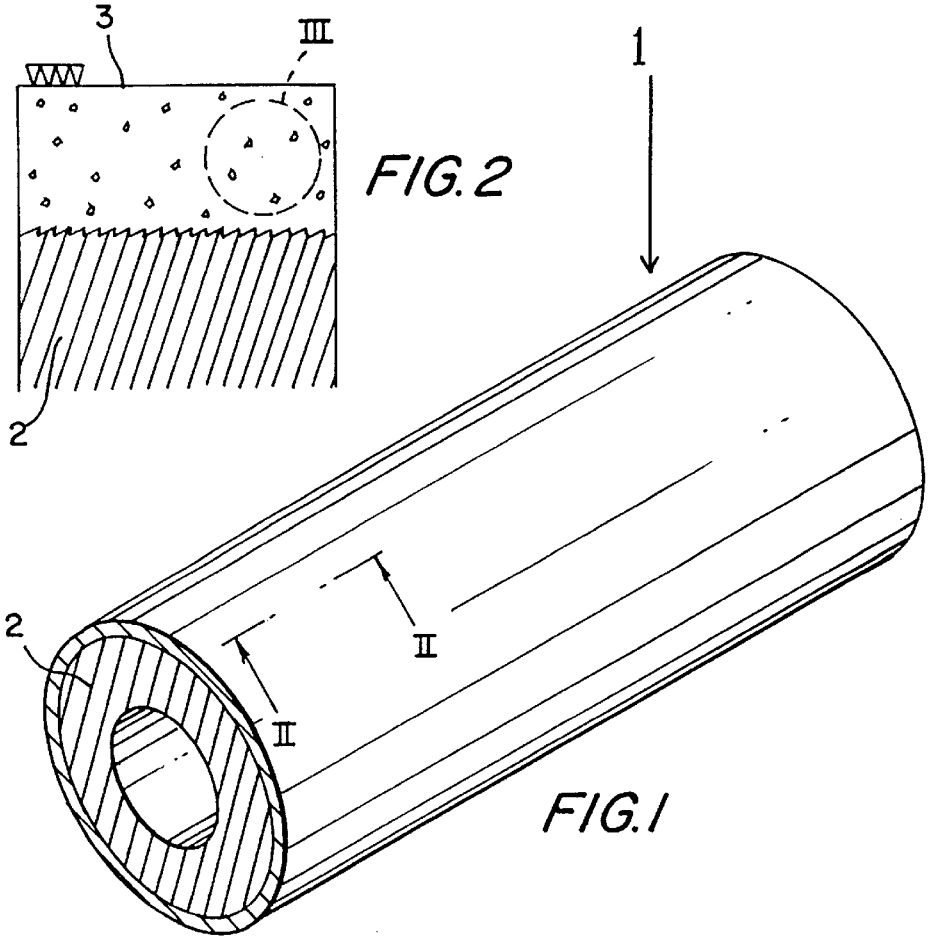
FIG.1

PRINTING MACHINE ROLLER, ESPECIALLY AN INK ROLLER, WITH AN INK-FRIENDLY COATING OF THE CYLINDER SURFACE OF THE ROLLER CORE

BACKGROUND OF THE INVENTION

1. Field of the Invention

The invention relates to a printing machine roller, especially an ink roller, preferably for offset machines. In offset machines, continuous rollers with a surface coating are widely used as ink distributor cylinders.

2. Discussion of the Prior Art

In various fields of technical construction, there is a need for surfaces that can be easily moistened with oils, mineral oil, and substances bound with mineral oil, such as offset inks. Moreover, these surfaces must also be highly water-repellent (hydrophobic), because otherwise the ink film can be expected to break up, leading to what is known as blanking.

In offset printing machines, the inking unit is responsible for transferring the thinnest possible film of ink evenly onto the printing plate cylinder. In modern printing machines, the ink is transported via a complex roller system. Starting from an ink box, where the quantity of ink is controlled according to zone by ink blades that are positioned against an ink ductor roller, the ink is transported via a so called ink vibrator or lifter, or directly via an intermediate roller into the inking unit. The inking unit itself consists of several rollers, some of which continue to provide cross-distribution, which are responsible for supplying the necessary quantity of ink, in a defined manner, to the ink rollers in direct contact with the printing plate. In modern printing machines, because the rheological properties of the ink are of decisive importance in the printing process, some ink rollers are temperature-controlled. That is, an attempt is made to keep the ink temperature in a range that is favorable for the offset printing process. Only in this way is it possible to control the ink separating processes between two ink rollers. These ink separating processes are necessary to ensure that the supplied ink is divided as desired into ink to be transported farther and ink to be returned. According to the current state of the art, inking units are composed essentially of roller combinations that comprise a rubber roller and a polyamide roller. A widely known brand name for the polyamide coatings of the polyamide rollers is Rilsan. The Rilsan coatings, depending on their manufacture, are between 0.3 mm and 1.0 mm thick. This material has heat conductivity values in the range of 0.22 to 0.25 W/mK. Very low heat conductivity sharply limits the effectiveness of the internal temperature moderation (e.g., by means of temperature-moderated water) of the ink film on the roller.

Due to the heat insulation of the Rilsan layer, the vital information needed by the temperature control system, namely the ink film temperature, is usually transmitted to the temperature-moderating medium late and in dampened fashion. In other words, the control speed and control accuracy of this system are sharply limited.

Recently, this fact has become problematic not only in fast rotary machines, but also, specifically, in the water-free offset machines known as Toray machines. In fast rotary machines, due to the high dynamics, the heating of the ink film in the inking unit, triggered by the flexing and friction work of the roller pairs relative to one another, is extremely great, so that stable processes at high speeds are inconceivable without expensive internal cooling systems. Despite such constructive measures, however, inks must also be adjusted so as to have, like motor oil, a viscosity range useful in offset technology. If only special inks without such a broad viscosity range are used, massive ink separation problems occur in fast rotary machines, because the rheological properties of the ink are no longer suitable for offset printing. Such difficulties can include ink grabbing, inadequate ink density, an overall tendency to over-emulsification, ink shearing, etc.

In water-less offset machines (Toray), it is even more important to maintain a constant ink film temperature. The ink film must be kept at a temperature of 30°±2° C. This cannot be done satisfactorily at this time with Rilsan-coated ink distributors. Only very low web speeds are currently possible, particularly in rotary machines for implementing the Toray process. The output of these machines is thus sharply limited.

SUMMARY OF THE INVENTION

Accordingly, it is an object of the present invention to provide an ink-friendly or ink-receptive coating for printing machine rollers that is comparable to Rilsan coatings and also has outstanding heat conductivity as well as high wear resistance that cannot be attained with previous copper coatings.

Pursuant to this object, and others which will become apparent hereafter, one aspect of the present invention resides in a printing machine roller having a roller core with an outer surface, and an ink-friendly coating provided on the outer surface of the roller core. The ink-friendly coating is a porous metal support layer with graphite particles embedded therein.

In a further embodiment of the invention the coating has a thickness of 0.03 mm to 1.5 mm, and preferably 0.1 mm.

In still another embodiment of the invention the coating has a surface roughness of $R_z \leqq 10\ \mu m$, and preferably $R_z = 8\ \mu m$.

From U.S. Pat. No. 2,908,068, it is known to coat ink transfer rollers with thickly applied (at least 0.6 mm) porous substances such as stainless steel, wolfram and molybdenum by means of the Schoop process. The Schoop process represents the original form of thermal spraying and was developed around the turn of the century. The flame spray method of that period has nothing in common with modern plasma spraying except for the concept of thermal spraying itself. Furthermore, it is now known that the description of ink-friendly properties of the materials in U.S. Pat. No. 2,908,068 is not accurate. On the contrary, the water-friendliness (or hydrophilic nature) is provided by the formation of passive layers such as $Cr_2O_3$ on stainless steel. In the case of molybdenum layers, an edge angle of roughly 54° relative to distilled water was found in laboratory tests. Compared to $Cr_2O_3$ layers, which are characterized by edge angles of approximately 70° relative to distilled water, this value is even lower, and suggests an even better wettability for water or aqueous solutions. This is due to the passive layers of the $MoO_3$ type. Tests of such layers in ink rollers of printing machines also led promptly to blanking problems. In other words, there is no certainty that Mo layers, with no further measures, are ink-friendly. The wear-reducing effect of Mo layers is known from numerous applications, especially from Otto engine construction.

Experimental studies have shown that the anti-corrosive effect of porous layers described in U.S. Pat. No. 2,908,068 according to the Schoop process does not exist, because an open porosity is involved which, after enough time, permits contact between the corrosive components of the offset inks and the non-corrosion-resistant basic roller material.

In keeping with the described temperature problem of ink transfer rollers in offset machines and the known weakness of copper layers relative to wear behavior and chemical stability and of molybdenum layers relative to blanking, the present invention attains the above-described object by using the markedly high heat conductivity, ink friendliness and chemical resistance of graphite in a metal matrix, e.g., of nickel, for this application. Layers of such substances have been used for years as sealing liners in compressor parts of gas turbines and, in general, as glide bearing materials with excellent anti-seizing properties. The latter use naturally implies ink friendliness, because the main component of offset inks is mineral oil. A glide bearing material with poor wettability for mineral oil would hardly be considered suitable. Graphite is known as a dry lubricant; the easy mobility of the individual grid planes of the hexagonal grid is the basic reason for this property. The grid consists of highly stable layer planes connected to each other by weak bonds. This layer structure is the reason for the marked anisotropy of the physical properties. The heat conductivity parallel to the layer is approximately 330 W/mK, and thus corresponds to the heat conductivity of copper. Vertical thereto, conductivity drops to roughly 2%. Layers of graphite in a nickel matrix are usually produced by thermal spraying or sintering processes. Because graphite particles with a nickel covering with a particle diameter that fluctuates between 5 $\mu$m and 150 $\mu$m are present in completely unordered spatial arrangements in layers of this type, anisotropy of the physical properties is again achieved. Based on one weight share of the nickel matrix relative to the graphite contained therein, which fluctuates between ratios of 55:45 to 95:5, a mean heat conductivity between approximately 120 W/mK and 75 W/mk is achieved. The nickel matrix is necessary as a support matrix, because the wear properties of pure graphite are inadequate for offset applications.

Comparable property profiles for offset applications can also be attained with other composite materials, e.g., polyester particles in an aluminum-silicon support matrix. In such cases, heat conductivity is provided by the aluminum-silicon matrix material and ink-friendliness is by produced by the polyester particles. In addition, due to the high heat effect during thermal spraying, a portion of the polyester is converted into graphite, so that gliding properties and thus wear resistance similar to those found in the glide bearing material of nickel graphite are again attained. Aluminum-silicon-polyester is also preferably processed by thermal spraying or sintering into layers. Both of the layer systems (i.e., nickel-graphite and aluminum-silicon-polyester) have in common a layer residual porosity that can be limited by the coating parameters within wide limits, from approximately 40% by volume to 4% by volume. This residual porosity makes possible a pore-closing seal with the help of an ink-friendly plastic sealer, so that this property can be adjusted to the individual case in offset machine use. Layers on printing machine rollers, especially ink rollers, can be produced from these materials with the described process in thickness of 30 $\mu$m to 1.5 mm. For the best possible heat conductivity, however, a layer thickness of 0.1 to 0.15 mm has proved suitable.

BRIEF DESCRIPTION OF THE DRAWING

FIG. 1 shows, in highly schematic fashion, the structure of an ink roller, whose roller core is covered according to the invention with a coating over the entire cylinder surface;

FIG. 2 is a partial section along line II—II in FIG. 1; and

FIG. 3 is an enlarged view of a portion III of FIG. 2.

DETAILED DESCRIPTION OF THE PREFERRED EMBODIMENTS

As can be seen in FIG. 1, the inventive ink roller 1 includes a roller cover 2 having a coating 3 over its entire outer surface. The coating 3, in accordance with the invention, is preferably used after being polished to a roughness of $R_z \approx 8$ to 12 $\mu$m. Depending on the use, it can be advantageous to change this roughness. The coating 3 according to the invention can be easily polished to roughnesses of up to $R_z \approx 3.0$ m and upward to virtually any desired roughness.

In connection with such a coating, extraordinarily good ink film stability results, even under extreme offset conditions (minimum ink pickup, large free areas), so that the feared blanking of the ink rollers no longer occurs.

The coating according to the invention is preferably applied by thermal spraying, especially plasma spraying or flame spraying. Other potentially suitable methods for producing the coating 3 are the PVD (physical vapor deposition) process, the CVD (chemical vapor deposition) process, the plasma-supported CVD process, the galvanic process with dispersion inlay, the sintering process, the high-temperature isostatic pressing process, and all reactive processes in which the coating according to the invention is created by deposition from two liquid or two gaseous phases.

FIG. 2 shows the coating applied to the surface of the roller core, while FIG. 3 shows the nickel-graphite structure of one embodiment of the invention.

The invention is not limited by the embodiments described above which are presented as examples only but can be modified in various ways within the scope of protection defined by the appended patent claims.

We claim:

1. Printing machine roller, comprising:

a roller core having an outer surface; and an ink-receptive coating provided on the outer surface of the roller core, the coating being a porous metal support layer with graphite particles embedded therein and the coating is sealed with a pore-closing ink receptive plastic.

2. A printing machine roller as defined in claim 1, wherein the metal support layer is a nickel matrix with inlaid graphite particles.

3. A printing machine roller as defined in claim 1, wherein the metal support layer is an aluminum-silicon matrix with inlaid graphitized polyester particles.

4. A printing machine roller as defined in claim 1, wherein the coating has a thickness of 0.03 mm to 1.5 mm.

5. A printing machine roller as defined in claim 4, wherein the coating has a thickness of 0.1 mm.

6. A printing machine roller as defined in claim 1, wherein the coating has a surface roughness of $R_z \leqq 10$ $\mu$m.

7. A printing machine roller as defined in claim 6, wherein the coating has a surface roughness of $R_z = 8$ $\mu$m.

8. A printing machine roller as defined in claim 1, wherein the printing machine roller is an ink distributor roller.

9. A printing machine roller, comprising:

a roller core having an outer surface; and an ink-receptive coating provided on the outer surface of the roller core, the coating being a porous metal support layer with graphite particles embedded therein, the metal support layer being an aluminum-silicone matrix with inlaid graphitized polyester particles.

10. A process for producing a printing machine roller, comprising the steps of:

providing a roller core having an outer surface;

applying an ink-receptive coating on the outer surface of the roller core, which coating is a porous metal support layer having graphite particles embedded therein; and sealing the coating with a pore-closing plastic receptive to ink.

11. A process as defined in claim 10, wherein the step of applying the coating includes thermally spraying the coating on the outer surface of the roller core.

12. A process as defined in claim 11, wherein the step of applying the coating includes one of plasma spraying and flame spraying the coating on the outer surface of the roller core.

13. A process as defined in claim 10, wherein the step of applying the coating includes applying the coating by physical vapor deposition, with a simultaneous deposition of nickel and graphite.

14. A process as defined in claim 10, wherein the step of applying the coating includes applying the coating to the outer surface of the roller core by chemical vapor deposition.

15. A process as defined in claim 10, wherein the step of applying the coating includes applying the coating by plasma-supported chemical vapor deposition.

16. A process as defined in claim 10, wherein the step of applying the coating includes galvanically applying the coating on the roller core with a simultaneous deposition of graphite polyester.

17. A process as defined in claim 10, wherein the step of applying the coating includes sintering the coating to the roller core.

18. A process as defined in claim 10, wherein the step of applying the coating includes high-temperature isostatic pressing of the coating onto the roller core.

19. A process as defined in claim 10, wherein the step of applying the coating to the roller core includes reactively converting the coating from one of two liquid phases and two gaseous phases.

20. A process as defined in claim 10, and further comprising the step of one of grinding and polishing the coating surface.

* * * * *